US009353326B1

(12) United States Patent
Fang et al.

(10) Patent No.: US 9,353,326 B1
(45) Date of Patent: May 31, 2016

(54) SYNERGISTIC FUEL ADDITIVES AND FUELS CONTAINING THE ADDITIVES

(71) Applicant: AFTON CHEMICAL CORPORATION, Richmond, VA (US)

(72) Inventors: Xinggao Fang, Midlothian, VA (US); Scott A. Culley, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 15/009,197

(22) Filed: Jan. 28, 2016

(51) Int. Cl.

| | |
|---|---|
| ***C10L 1/22*** | (2006.01) |
| ***C10L 10/08*** | (2006.01) |
| ***F02B 51/00*** | (2006.01) |
| *C10L 1/224* | (2006.01) |
| *C10L 1/222* | (2006.01) |

(52) U.S. Cl.
CPC . *C10L 10/08* (2013.01); *C10L 1/22* (2013.01); *F02B 51/00* (2013.01); *C10L 1/224* (2013.01); *C10L 1/2225* (2013.01); *C10L 2200/0259* (2013.01); *C10L 2270/023* (2013.01)

(58) Field of Classification Search
CPC ..... C10L 10/08; C10L 1/22; C10L 1/224; C10L 1/2225; C10L 2200/0259; C10L 2270/023; F02B 51/00
See application file for complete search history.

(56) References Cited

U.S. PATENT DOCUMENTS

| | | | | |
|---|---|---|---|---|
| 3,761,523 | A * | 9/1973 | Reid | C07C 215/12 564/477 |
| 4,512,903 | A | 4/1985 | Schlicht et al. | |
| 6,057,273 | A * | 5/2000 | Oumar-Mahamat | C10L 1/143 508/551 |
| 7,195,654 | B2 | 3/2007 | Jackson et al. | |
| 8,388,704 | B2 * | 3/2013 | Watanabe | C10L 10/08 44/385 |
| 8,425,627 | B2 | 4/2013 | Dietz et al. | |

FOREIGN PATENT DOCUMENTS

| | | |
|---|---|---|
| EP | 0869163 A1 | 10/1998 |

* cited by examiner

*Primary Examiner* — Cephia D Toomer
(74) *Attorney, Agent, or Firm* — Luedeka Neely Group, P.C.

(57) ABSTRACT

A fuel additive for a gasoline fuel composition, a gasoline fuel composition and a method for reducing wear in a gasoline delivery system of an engine. The fuel additive includes a synergistic mixture of (i) N,N-bis(hydroxyalkyl)-alkylamine, and (ii) an amide reaction product of a hydroxy acid, hydroxy ester, or lactone and an amine or ether amine, wherein a weight ratio of (i) to (ii) in the synergistic mixture ranges from about 1:5 to about 5:1.

19 Claims, No Drawings

SYNERGISTIC FUEL ADDITIVES AND FUELS CONTAINING THE ADDITIVES

TECHNICAL FIELD

The disclosure is directed to fuel additives that provide synergistic improvements for fuel composition and to fuel compositions containing the synergistic additives. In particular, the disclosure relates to a gasoline fuel additive mixture that includes (i) N,N-bis(hydroxyalkyl)-alkylamine, and (ii) an amide reaction product of a hydroxy acid and an amine or ether amine, wherein the additive mixture has synergistic properties with respect to fuel system component wear and/or low temperature stability.

BACKGROUND AND SUMMARY

Fuel compositions for vehicles are continually being improved to enhance various properties of the fuels in order to accommodate their use in newer, more advanced engines including direct injection gasoline engines. Accordingly, fuel compositions typically include additives that are directed to certain properties that require improvement. For example, friction modifiers, such as fatty acid amides, are added to fuel to reduce friction and wear in the fuel delivery systems of an engine. When such additives are added to the fuel rather than the lubricant, a portion of the additives are transferred into the lubricant in the engine piston ring zone where it may reduce friction and wear and thus improve fuel economy. While such additives may be beneficially added to the lubricant rather than the fuel, such additive are not effective for improving lubricity and reducing wear in fuel delivery systems when added to the lubricant. Such fuel additives may be passed into the oil sump during engine operation, so that a fuel additive that is also beneficial to the engine lubricant is desirable. However, certain fatty amides may be unstable in additive packages for fuels at low storage temperatures and the performance of such fatty acid amides is often less than desirable.

Partial esters of fatty acid and polyhydroxy alcohols such as glycerol monooleate (GMO) are known as friction modifiers for lubricant compositions. Likewise, diethanolamine fatty amides are also well known friction modifiers. While GMO and fatty amide friction modifiers may improve fuel economy when added to a lubricant, GMO and certain diethanolamine fatty amides may be unstable in additive packages for fuels or may cause an increase in intake valve deposits in gasoline engines. Furthermore, the fuel economy improvement may be less than desirable when using GMO or certain fatty amides in fuel compositions. Accordingly, GMO and fatty amide friction modifiers cannot be beneficially added to a fuel composition to improve the wear protection of the fuel delivery system without harmful and undesirable side effects.

Fatty amine ethoxylates are also known as fuel additives that may reduce fuel consumption. However, such fatty amine ethoxylates are typically derived from natural sources and thus may vary by region and over time. In addition, some fatty amine ethoxylates have a high freezing points or are solids at room temperature and may require heating or the use of a solvent for storage and handling. Lastly, fatty amine ethoxylates typically have poor low temperature compatibility in fuel additive compositions.

Many other friction modifiers have been tried, however there remains a need for a friction modifier that enables a fuel additive packages containing the friction modifier to remain liquid at low temperatures, that is resistant to hydrolysis, that may be readily formulated into a fuel additive packages, that offers good fuel economy benefits, and that provides wear protection to fuel delivery systems, among others characteristics. Accordingly, there continues to be a need for a fuel additive that is cost effective to manufacture and improves multiple characteristics of a fuel.

In accordance with the disclosure, exemplary embodiments provide a fuel additive for a gasoline fuel composition that includes a synergistic mixture of (i) N,N-bis(hydroxyalkyl)-alkylamine, and (ii) an amide reaction product of a hydroxy acid, hydroxy ester or lactone and an amine or ether amine, wherein a weight ratio of (i) to (ii) in the synergistic mixture ranges from about 1:5 to about 5:1.

In another embodiment, there is provided a gasoline fuel composition for reducing fuel system component wear. The fuel composition includes gasoline and a fuel additive mixture of (i) N,N-bis(hydroxyalkyl)-alkylamine, and (ii) an amide reaction product of a hydroxy acid, hydroxy ester, or lactone and an amine or ether amine, wherein a weight ratio of (i) to (ii) in the synergistic fuel additive mixture ranges from about 1:5 to about 5:1.

A further embodiment provides a method for reducing wear of a gasoline engine. The method includes providing gasoline containing a wear reducing additive mixture consisting essentially of (i) N,N-bis(hydroxyalkyl)-alkylamine, and (ii) an amide reaction product of a hydroxy acid, hydroxy ester, or lactone and an amine or ether amine, wherein a weight ratio of (i) to (ii) in the additive mixture ranges from about 1:5 to about 5:1; combining the additive mixture with gasoline to provide a fuel composition; and operating the engine on the fuel composition.

As set forth above, a fuel additive composition containing each of the components alone may not be stable at low temperatures. Thus it was surprising and quite unexpected that the mixture of components (i) and (ii) described above would provide a stable additive composition that remains liquid at low temperature and also provide a synergistic improvement in wear reduction of a fuel composition containing the additive mixture. The additive mixture also provides suitable fuel economy increase that is at least as good, if not better than the fuel economy increase provided by the individual components.

In a further embodiment, the fuel composition contains from about 10 to about 1500 ppm by weight, such as from about 40 to about 750 ppm by weight, or from about 50 to about 500 ppm by weight, or from about 50 to about 300 ppm by weight of the synergistic additive mixture.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The synergistic fuel additive mixture of the present disclosure may be used in a minor amount in a major amount of fuel and may be added to the fuel directly or added as a component of an additive concentrate to the fuel. A suitable fuel additive mixture may contain a weight ratio of component (i) to component (ii) of from about 1:5 to about 5:1, such as from about 1:3 to about 3:1, or from about 1:2 to about 2:1, and all ranges therebetween.

As used herein, the term “hydrocarbyl group” or “hydrocarbyl” is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

Bis(hydroxyalkyl)-alkylamine Compound

The N,N-bis(hydroxyalkyl)-alkylamine typically has short chain ($C_2$-$C_4$) hydroxyalkyl groups and a long chain ($C_8$-$C_{25}$) alkyl group. A preferred compound of this type is dihydroxyethylcocoamine. The compounds used as the effective friction reducing agents have the following structure:

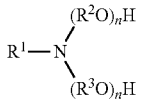

wherein $R^1$ is a hydrocarbyl group having from 8 to 25 carbon atoms, such as from about 10 to 20 carbon atoms or from 12 to 18 carbon atoms, $R^2$ and $R^3$ are independently selected from linear or branched hydrocarbyl groups containing from 2 to 4 carbon atoms, and n is an integer ranging from 1 to 4. A suitable N,N-bis(hydroxyalkyl)-alkylamine is N,N-bis(hydroxyethyl) n-cocoamine which is usually derived from coconut fatty acid so that the $R^1$ substituent generally ranges from $C_8$ to $C_{18}$, with $C_{12}$ and $C_{14}$ groups predominating mostly straight chain.

The foregoing compounds may be prepared using any of the methods for preparing ethoxylated amines which are well known in the art. Generally, ethoxylated amines may be prepared by the reaction of the appropriate hydrocarbyl amine with ethylene oxide, often catalyzed, to form the corresponding ethoxylated amine. Examples of ethoxylated amines include, but are not limited to, diethoxylated tallowamine, diethoxylated oleylamine, diethoxylated stearylamine, and the diethoxylated amine from soybean oil fatty acids. Fatty amine ethoxylates are widely available commercially.

The concentration of the hydroxyalkyl alkylamine (HAAA) additive in the gasoline is usually at least 5 ppm by weight, such as from about 5 to about 750 ppm by weight, typically from about 40 to about 500 ppm by weight, and desirably from about 50 to about 250 ppm by weight based on a total weight of a gasoline composition containing the HAAA.

Amide Compound

The amide compound used in combination with the bis (hydroxyalkyl)alkylamine compound described above is a compound of the formula

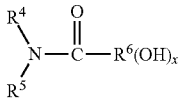

wherein $R^4$ and $R^5$ are the same or different and each may be selected from hydrogen and a saturated or unsaturated hydrocarbyl radical containing from 6 to 30 carbon atoms, provided no more than one of $R^4$ and $R^5$ is hydrogen, and $R^6$ is a divalent hydrocarbyl radical containing from 1 to 10 carbon atoms, and x is 1 or 2. In one embodiment, $R^6$ contains from 1 to 4 carbon atoms and in another embodiment, $R^6$ is a —$CH_2$—. The foregoing amide compound may be made by reacting a hydroxyl-substituted monocarboxylic acid with a suitable primary or secondary amine or ether amine.

The acids may be selected from glycolic acid, lactic acid, 3-hydroxypropionic acid, gama-hydroxy butyric acid, and 2,2-bis$(HOCH_2)_2$ propionic acid. Lactones such as beta-propiolactone, gammabutyrolactones, and esters such as methyl or ethyl glycolates, lactates, and the like may be used in place of the acids to prepare the above amide compounds.

According to the disclosure, any suitable primary or secondary amine or ether-amine may be used to prepare the amide compound of the above formula. Representative amines include, but are not limited to isohexylethylamine, isohexylpropylamine, 2-ethylhexylamine, 2-ethylhexylethylamine, 2-ethylhexylpropylamine, octyl/decylethylamine, octyl/decylpropylamine, isodecylethylamine, isodecylpropylamine, isododecylethylamine, isododecylpropylamine, isotridecylethylamine, isotridecylpolypropylamine, isotridecylpoly-$C_2$-$C_4$-propylamine, isotridecylpropylamine, $C_{12}$-$C_{15}$-alkylethylamine, $C_{12}$-$C_{15}$-alkylpropylamine, $C_{16}$-$C_{18}$-alkylethylamine, $C_{16}$-$C_{18}$-alkylpropylamine, and the like.

Representative etheramines include, but are not limited to, isohexyloxyethylamine, isohexyloxypropylamine, 2-ethylhexyloxyethylamine, 2-ethylhexyloxypropylamine, octyl/decyloxyethylamine, octyl/decyloxypropylamine, isodecyloxyethylamine, isodecyloxypropylamine, isododecyloxyethylamine, isododecyloxypropylamine, isotridecyloxyethylamine, isotridecyloxypolypropoxypropylamine, isotridecyloxypoly-$C_2$-$C_4$-oxypropylamine, isotridecyloxypropylamine, $C_{12}$-$C_{15}$-alkyloxyethylamine, $C_{12}$-$C_{15}$-alkyloxypropylamine, $C_{16}$-$C_{18}$-alkyloxyethylamine, $C_{16}$-$C_{18}$-alkyloxypropylamine, and the like.

One or more additional optional compounds may be present in the fuel additive compositions of the disclosed embodiments. For example, the fuel additives may contain conventional quantities of octane improvers, corrosion inhibitors, cold flow improvers (CFPP additive), pour point depressants, solvents, demulsifiers, lubricity additives, additional friction modifiers, amine stabilizers, combustion improvers, dispersants, detergents, antioxidants, heat stabilizers, conductivity improvers, metal deactivators, carrier fluid, marker dyes, organic nitrate ignition accelerators, cyclomatic manganese tricarbonyl compounds, and the like. In some aspects, the additive compositions described herein may contain about 10 weight percent or less, or in other aspects, about 5 weight percent or less, based on the total weight of the additive composition, of one or more of the above additives. Similarly, the fuels may contain suitable amounts of conventional fuel blending components such as methanol, ethanol, dialkyl ethers, 2-ethylhexanol, and the like.

In one embodiment, a fuel additive package may contain the above described synergistic mixture of bis(hydroxyalkyl) alkylamine and amide reaction product of a hydroxy acid and an amine or ether amine in combination with a carrier fluid and other ingredients selected from one or more detergents selected from Mannich base detergents, polyalkylamines, polyalkylpolyamines, polyalkenyl succinimides, and quaternary ammonium salt detergents. Quaternary ammonium salt detergents may be selected from compounds of the formula

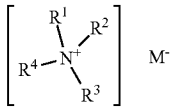

wherein each of $R^1$, $R^2$, $R^3$, and $R^4$ is selected from a hydrocarbyl group containing from 1 to 50 carbon atoms, wherein at least one and not more than three of $R^1$, $R^2$, $R^3$, and $R^4$ is a hydrocarbyl group containing from 1 to 4 carbon atoms and at least one of $R^1$, $R^2$, $R^3$, and $R^4$ is a hydrocarbyl group containing from 8 to 50 carbon atoms, $M^-$ is selected from the group consisting of carboxylates, nitrates, nitrides, nitrites, hyponitrites, phenates, carbamates, carbonates, and mixtures thereof, wherein the carboxylate is not an oxalate or formate; alkoxylated quaternary ammonium salts derived from epoxides, tertiary amines, and optional protonating agents; reaction products of amido amines or acylated amines containing at least one tertiary amino group and epoxides; reaction products of hydrocarbyl substituted anhydrides, tertiary amines and hydroxyl-containing epoxides; esterified quaternary ammonium salts derived from tertiary amines, epoxides, proton donors and anhydrides; reaction products of hydrocarbyl substituted compounds containing at least one tertiary amino group selected from $C_{10}$-$C_{30}$-alkyl or alkenyl-substituted amidopropyldimethylamines and $C_{12}$-$C_{200}$-alkyl or alkenyl-substituted succinic-carbonyldimethylamines and halogen substituted $C_2$-$C_8$ carboxylic acids, esters, amides, or salts thereof; and mixtures two or more of the foregoing detergents.

Suitable carrier fluids may be selected from any suitable carrier fluid that is compatible with the gasoline and is capable of dissolving or dispersing the components of the additive package. Typically, the carrier fluid is a hydrocarbyl polyether or a hydrocarbon fluid, for example a petroleum or synthetic lubricating oil basestock including mineral oil, synthetic oils such as polyesters or polyethers or other polyols, or hydrocracked or hydroisomerised basestock. Alternatively, the carrier fluid may be a distillate boiling in the gasoline range. The amount of carrier fluid contained in the additive package may range from 10 to 80 wt %, or from 20 to 75 wt. %, or from 30 to 60 wt % based on a total weight of the additive package. Such additive packages containing the polyhydroxyalkyl ether amine additive, detergent and carrier fluid was found to remain as clear fluids even at temperatures as low as −20 to −30° C.

The additive mixture of the present disclosure, including the N,N-bis(hydroxyalkyl)-alkylamine and amide compound described above, and optional additives used in formulating the fuels of this invention may be blended into the base fuel individually or in various sub-combinations. In some embodiments, the synergistic additive mixture of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline engines. The engines include both stationary engines (e.g., engines used in electrical power generation installations, in pumping stations, etc.) and ambulatory engines (e.g., engines used as prime movers in automobiles, trucks, road-grading equipment, military vehicles, etc.).

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

In the following example, a friction test was conducted on an E-10 gasoline fuel. All of the runs contained Eli) gasoline and the amount of additive listed in the table. The friction tests were conducted using a high frequency reciprocating rig (HFRR) using method ASTM D 6079 that was modified to allow testing the gasoline at a temperature of 25° C.

TABLE 1

| Ex No. | Additive | Treat Rate (ppmw) | HFRR MWSD (μm) |
|---|---|---|---|
| 1 | E-10 base fuel with no additive | 0 | 804 |
| 2 | E-10 base fuel plus Mannich detergent and alkyl polyether | 280 | 805 |
| 3 | Run 2 plus glycerol mono cocoate | 40 | 761 |
| 4 | Run 2 plus cocoamine diethoxylate | 40 | 725 |
| 5 | Run 2 plus cocoamine diethoxylate | 80 | 694 |
| 6 | Run 2 plus reaction product of glycolic acid and amine derived from propylene oxide adduct of $C_{12}$-$C_{14}$ alcohol | 80 | 768 |
| 7 | Run 2 plus reaction product of glycolic acid and isodecyloxypropylamine | 80 | 702 |

TABLE 1-continued

| Ex No. | Additive | Treat Rate (ppmw) | HFRR MWSD (μm) |
|---|---|---|---|
| 8 | Run 2 plus reaction product of glycolic acid and 2-ethylhexylamine | 80 | 765 |
| 9 | Run 2 plus cocoamine diethoxylate/reaction product of glycolic acid and 2-ethylhexylamine | 40/40 | 669 |
| 10 | Run 2 plus cocoamine diethoxylate/reaction product of glycolic acid and isodecyloxypropylamine | 40/40 | 674 |
| 11 | Run 2 plus cocoamine diethoxylate/reaction product of glycolic acid and amine derived from propylene oxide adduct of $C_{12}$-$C_{14}$ alcohol | 60/20 | 690 |
| 12 | Run 2 plus cocoamine diethoxylate/reaction product of glycolic acid and amine derived from propylene oxide adduct of $C_{12}$-$C_{14}$ alcohol | 20/60 | 685 |
| 13 | Run 2 plus cocoamine diethoxylate/reaction product of glycolic acid and amine derived from propylene oxide adduct of $C_{12}$-$C_{14}$ alcohol | 40/40 | 683 |

Example Nos. 1 to 8 in the above table provide the HFRR data for the base fuel, the base fuel plus detergent and carrier fluid, and the base fuel plus detergent and carrier fluid plus each one of the components of the additive mixture individually. As shown, all of the Examples 1-8 had HFRR wear scars above 690 microns. Accordingly, it was surprising and quite unexpected that the mixtures of bis(hydroxyalkyl)alkylamine and amide of Examples 9-13 would provide lower HFRR wear scars than the individual components. Such synergistic effect of the combination of ingredients could not be predicted from the data of Examples 3-8.

An important characteristic of the synergistic fuel additives of the disclosure is the low temperature stability of a fuel additive package containing the synergistic mixture of bis(hydroxyalkyl)alkylamine and amide described above. An advantage of providing the additive in a fuel additive package rather than in a lubricant composition is that the additive is continually renewed over time as fuel is combusted in the engine. By contrast, as the lubricant ages, additives provided by the lubricant are typically depleted over time. Accordingly, in order to provide sufficient additive to a fuel to improve the fuel economy of an engine, the additive package containing the foregoing mixture of bis(hydroxyalkyl)alkylamine and amide must be stable, and remain stable at low temperatures in order to be useful as a fuel additive. By "stable" is meant the additive package remains a clear liquid at temperatures as low as −20° C. over a period of time.

In the following examples, the storage stability of gasoline fuel additive packages containing the synergistic mixture of bis(hydroxyalkyl)alkylamine and amide (Ex. Nos. 9-14) were compared to additive packages containing only one of the two components (Ex. Nos. 1-7). Example 8 contained a non-synergistic mixture of the additive of Examples 3 and 4. Each of the additive packages in the following table contained 53.85 wt. % of a commonly used Mannich base detergent and an aromatic solvent. The amount of additive and aromatic solvent in each of the examples is given in the table below.

TABLE 2

| Ex No. | Additive | Treat Rate Grams | 1 day at −20° C. | 1 week at −20° C. |
|---|---|---|---|---|
| 1 | Reaction product of glycolic acid and 2-ethylhexyl-amine/Aromatic solvent | 30.77/ 15.38 | Hazy-2 layer | |
| 2 | Reaction product of glycolic acid and isodecyloxypropylamine/Aromatic solvent | 30.77/ 15.38 | Slightly hazy | |

TABLE 2-continued

| Ex No. | Additive | Treat Rate Grams | 1 day at −20° C. | 1 week at −20° C. |
|---|---|---|---|---|
| 3 | Glycerol mono cocoate/Aromatic solvent | 30.77/ 15.38 | Solid | |
| 4 | Cocoamine diethoxylate/Aromatic solvent | 30.77/ 15.38 | Solid | |
| 5 | Reaction product of glycolic acid and amine derived from propylene oxide adduct of $C_{12}$-$C_{14}$ alcohol/Aromatic solvent | 30.77/ 15.38 | Slightly hazy | |
| 6 | Cocoamine diethoxylate/Aromatic solvent | 23.08/ 23.08 | solid | |
| 7 | Reaction product of glycolic acid and amine derived from propylene oxide adduct of $C_{12}$-$C_{14}$ alcohol/Aromatic solvent | 23.08/ 23.08 | Hazy | Gel bottom |
| 8 | Cocoamine diethoxylate/Glycerol mono cocoate/Aromatic solvent | 15.88/ 15.88/ 15.38 | solid | |
| 9 | Cocoamine diethoxylate/reaction product of glycolic acid and 2-ethylhexyl-amine/Aromatic solvent | 15.88/ 15.88/ 15.38 | CB | CB |
| 10 | Cocoamine diethoxylate/reaction product of glycolic acid and isodecyloxypropyl-amine/Aromatic solvent | 15.88/ 15.88/ 15.38 | CB | CB |
| 11 | Cocoamine diethoxylate/reaction product of glycolic acid and amine derived from propylene oxide adduct of $C_{12}$-$C_{14}$ alcohol/Aromatic Solvent | 10.25/ 20.5/ 15.38 | CB | CB |
| 12 | Cocoamine diethoxylate/reaction product of glycolic acid and amine derived from propylene oxide adduct of $C_{12}$-$C_{14}$ alcohol/Aromatic Solvent | 11.54/ 11.54/ 23.08 | CB | CB |
| 13 | Cocoamine diethoxylate/reaction product of glycolic acid and amine derived from propylene oxide adduct of $C_{12}$-$C_{14}$ alcohol/Aromatic Solvent | 15.39/ 7.69/ 23.08 | CB | CB |
| 14 | Cocoamine diethoxylate/reaction product of glycolic acid and amine derived from propylene oxide adduct of $C_{12}$-$C_{14}$ alcohol/Aromatic Solvent | 7.69/ 15.39/ 23.08 | CB | CB |

As shown in Table 2, each of the fuel additives containing the synergistic mixture of bis(hydroxyalkyl)alkylamine and amide (Ex. Nos. 9-14) remained clear and bright (CB) after a week at a temperature of −20° C. whereas the additive packages containing the individual components of the mixture (Ex. Nos. 1-7) were either solid or hazy after only one day at −20° C. Likewise, the non-synergistic mixture Ex. 8 was a solid after 1 day at −20° C. Accordingly, the combination of bis(hydroxyalkyl)alkylamine and amide may be used to improve the low temperature storage stability of a fuel additive composition.

Modified Sequence VI E Dynamometer Testing

Modified Sequence VIE testing was carried out using a General Motors 3.6 L (LY7) V6, 4-cycle engine. The test fuel was unleaded reference gasoline and the motor oil was a formulated SAE 0W-20 passenger car engine oil containing all of the standard engine oil components, but containing no friction modifiers. The friction modifier to be tested was solubilized in a small amount of the Sequence VIE motor oil to make a top-treat. The concentration of friction modifier in the top-treat was such that when it was added to the crankcase the concentration of friction modifier in the engine lubricant was 0.125 wt. %. The engine was operated with the baseline engine oil at 1500 rpm, a torque of 150 N-m, an oil temperature of 115° C. and a coolant temperature of 109° C. until the temperatures stabilized. The brake specific fuel consumption (BSFC) was measured for approximately one hour after stabilization. The top-treat containing the friction modifier was then added to the crankcase. Upon the addition of the top-treat, the BSFC decreased over the course of about five minutes. The engine was run until the BSFC stabilized, after which the fuel consumption was then measured for approximately one hour. The fuel economy improvement was calculated from the average BSFC before and after the addition of the friction modifier top-treat. The fuel economy increase values listed in the table were adjusted for engine hours and were based on a reference fluid that was tested periodically.

TABLE 3

Fuel Economy Increase

| Run No. | Synergistic Mixture in engine oil | % Fuel Economy Increase |
|---|---|---|
| 1 | Base oil, plus no top treat additive | 0 |
| 2 | Cocoamine diethoxylate/reaction product of glycolic acid and amine derived from propylene oxide adduct of $C_{12}$-$C_{14}$ amine in a wt. ratio of 1:1 | 1.21 |
| 3 | Cocoamine diethoxylate/reaction product of glycolic acid and 2-ethylhexyl-amine in a wt. ratio of 3:2 | 1.16 |

As shown in the foregoing table, the synergistic mixture of bis(hydroxyalkyl)alkylamine and amide provided significant fuel economy increase in an engine oil composition compared to the base oil composition that was devoid of the synergistic mixture. Accordingly, in addition to wear reduction and low temperature stability, the synergistic mixture is also effective to provide fuel economy improvements in gasoline fuels.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel additive for a gasoline fuel composition comprising a synergistic mixture of (i) N,N-bis(hydroxyalkyl)-alkylamine, and (ii) an amide reaction product of a hydroxy acid, hydroxy ester or lactone and an amine or ether amine, wherein a weight ratio of (i) to (ii) in the synergistic mixture ranges from about 1:5 to about 5:1.

2. The fuel additive of claim 1, wherein the N,N-bis(hydroxyalkyl)-alkylamine comprises a compound of the formula

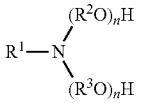

wherein $R^1$ is a hydrocarbyl group having from 8 to 25 carbon atoms, $R^2$ and $R^3$ are independently selected from hydrocarbyl groups containing from 2 to 4 carbon atoms, and n ranges from 1 to 4.

3. The fuel additive of claim 1, wherein the amide reaction product is a compound of the formula

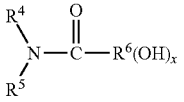

wherein $R^4$ and $R^5$ are the same or different and each may be selected from hydrogen and a saturated or unsaturated hydrocarbyl radical containing from 6 to 30 carbon atoms, provided no more than one of $R^4$ and $R^5$ is hydrogen, $R^6$ is a divalent hydrocarbyl radical containing from 1 to 10 carbon atoms, and x is 1 or 2.

4. The fuel additive of claim 3, wherein $R^4$ and $R^5$ are independently selected from hydrocarbyl groups containing from 8 to 30 carbon atoms.

5. The fuel additive of claim 1, further comprising one or more detergents and one or more carrier fluids, wherein the fuel additive remains a clear liquid at a temperature of −20° C. or below.

6. The fuel additive of claim 1, further comprising a quaternary ammonium salt detergent.

7. A gasoline fuel composition comprising from about 10 to about 1500 ppm by weight of the fuel additive of claim 1 based on a total weight of the fuel composition.

8. The gasoline fuel composition of claim 7, wherein the fuel composition has a high frequency reciprocating rig (HFRR) wear scar of no more than 690 μm.

9. A method for operating a fuel injected gasoline engine comprising combusting in the engine the fuel composition of claim 7.

10. A gasoline fuel composition for reducing fuel system component wear comprising gasoline and a fuel additive mixture of (i) N,N-bis(hydroxyalkyl)-alkylamine, and (ii) an amide reaction product of a hydroxy acid, hydroxy ester or lactone and an amine or ether amine, wherein a weight ratio of (i) to (ii) in the fuel additive mixture ranges from about 1:5 to about 5:1.

11. The fuel composition of claim 10, wherein the N,N-bis (hydroxyalkyl)-alkylamine comprises a compound of the formula

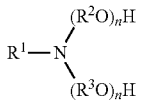

wherein $R^1$ is a hydrocarbyl group having from 8 to 25 carbon atoms, $R^2$ and $R^3$ are independently selected from hydrocarbyl groups containing from 2 to 4 carbon atoms, and n ranges from 1 to 4.

12. The fuel composition of claim 10, wherein the amide reaction product is a compound of the formula

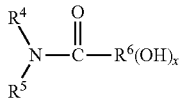

wherein $R^4$ and $R^5$ are the same or different and each may be selected from hydrogen and a saturated or unsaturated hydrocarbyl radical containing from 6 to 30 carbon atoms, provided no more than one of $R^4$ and $R^5$ is hydrogen, $R^6$ is a divalent hydrocarbyl radical containing from 1 to 10 carbon atoms, and x is 1 or 2.

13. The fuel composition of claim 10, comprising from about 10 to about 1500 ppm by weight of the fuel additive mixture based on a total weight of the fuel composition.

14. The fuel composition of claim 10, wherein the fuel additive mixture further comprising one or more detergents and one or more carrier fluids, and wherein the fuel additive mixture remains a clear liquid at a temperature of −20° C. or below.

15. A method for operating a fuel injected gasoline engine comprising combusting in the engine the fuel composition of claim 10.

16. A method for reducing wear in a fuel delivery system of a gasoline engine, comprising:

providing gasoline containing a wear reducing additive mixture consisting essentially of (i) N,N-bis(hydroxyalkyl)-alkylamine, and (ii) an amide reaction product of a hydroxy acid, hydroxy ester, or lactone and an amine or ether amine, wherein a weight ratio of (i) to (ii) in the additive mixture ranges from about 1:5 to about 5:1;

combining the additive mixture with gasoline to provide a fuel composition; and operating the engine on the fuel composition.

17. The method of claim 16, wherein the N,N-bis(hydroxyalkyl)-alkylamine comprises a compound of the formula

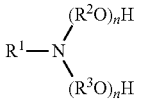

wherein $R^1$ is a hydrocarbyl group having from 8 to 25 carbon atoms, $R^2$ and $R^3$ are independently selected from hydrocarbyl groups containing from 2 to 4 carbon atoms, and n ranges from 1 to 4.

18. The method of claim 16, wherein the amide reaction product is a compound of the formula

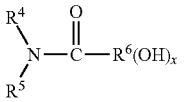

wherein $R^4$ and $R^5$ are the same or different and each may be selected from hydrogen and a saturated or unsaturated hydrocarbyl radical containing from 6 to 30 carbon atoms, provided no more than one of $R^4$ and $R^5$ is hydrogen, $R^6$ is a divalent hydrocarbyl radical containing from 1 to 10 carbon atoms, and x is 1 or 2.

19. The method of claim 16, wherein the fuel composition comprises from about 10 to about 500 ppm by weight of the additive based on a total weight of the fuel composition.

* * * * *